US008287660B2

(12) United States Patent
Chen et al.

(10) Patent No.: US 8,287,660 B2
(45) Date of Patent: Oct. 16, 2012

(54) UPPER SPRAY ARM WATER DEFLECTOR

(75) Inventors: David H. Chen, Saint Joseph, MI (US); Donald J. Wilson, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 438 days.

(21) Appl. No.: 12/699,250

(22) Filed: Feb. 3, 2010

(65) Prior Publication Data

US 2011/0186085 A1 Aug. 4, 2011

(51) Int. Cl.
*A47L 15/22* (2006.01)

(52) U.S. Cl. ..... 134/56 D; 134/57 D; 134/172; 134/176; 134/198

(58) Field of Classification Search ..... 134/56 D, 134/57 D, 172, 176, 198
See application file for complete search history.

(56) References Cited

U.S. PATENT DOCUMENTS

| | | | |
|---|---|---|---|
| 5,135,014 | A | 8/1992 | Beswick |
| 5,577,665 | A | 11/1996 | Chang |
| 5,673,714 | A | 10/1997 | Campagnolo et al. |
| 5,697,392 | A | 12/1997 | Johnson et al. |
| 6,631,860 | B2 | 10/2003 | Bachmann et al. |
| 6,742,531 | B2 | 6/2004 | Christman et al. |
| 7,225,818 | B2 | 6/2007 | Kim et al. |
| 7,458,618 | B2 | 12/2008 | Mahnken et al. |
| 7,552,877 | B2 | 6/2009 | Grant |
| 2001/0038044 | A1 | 11/2001 | Bachmann et al. |
| 2003/0183255 | A1 | 10/2003 | Kim et al. |
| 2003/0205248 | A1 | 11/2003 | Christman et al. |
| 2006/0091232 | A1 | 5/2006 | Grant |
| 2006/0157592 | A1 | 7/2006 | Mahnken et al. |
| 2009/0145981 | A1 | 6/2009 | Mack et al. |
| 2009/0178698 | A1 | 7/2009 | Delgado |

*Primary Examiner* — Saeed T Chaudhry
(74) *Attorney, Agent, or Firm* — Jacquelyn Lin; Barnes & Thornburg LLP

(57) ABSTRACT

A dishwashing machine includes a washing chamber, a spray jet, and a spray arm positioned below the spray jet. The spray arm has a deflector fin extending upwardly there from. The spray arm is rotated when the fluid stream generated by the spray jet contacts the deflector fin.

18 Claims, 4 Drawing Sheets

UPPER SPRAY ARM WATER DEFLECTOR

TECHNICAL FIELD

The present disclosure relates generally to a dishwashing machine and more particularly to a spray arm for a dishwashing machine.

BACKGROUND

A dishwashing machine is a domestic appliance into which dishes and other cooking and eating wares (e.g., plates, bowls, glasses, flatware, pots, pans, bowls, etcetera) are placed to be washed. A dishwashing machine includes at least one spray arm that sprays water over the wares to clean such wares.

SUMMARY

According to one aspect, a dishwashing machine includes a washing chamber and a basket positioned within the washing chamber. The basket is configured to receive flatware. The dishwashing machine also includes a spray jet positioned above the basket. The spray jet is operable to generate a fluid stream directed toward a portion of the basket. The dishwashing machine also includes a rotatable spray arm positioned between the spray jet and the basket. The spray arm has a deflector fin extending upwardly there from. The spray arm is rotated when the fluid stream from the spray jet contacts the deflector fin.

In some embodiments, the spray arm may include a number of nozzles configured to spray fluid throughout the washing chamber, and the spray jet may be deactivated when the number of nozzles of the spray arm are spraying fluid. In some embodiments, the spray arm may rotate about an imaginary axis extending upwardly from a bottom surface of the washing chamber when the number of nozzles of the spray arm are spraying fluid. Additionally, in some embodiments, a second deflector fin may extend upwardly from the spray arm, and the imaginary axis may be positioned between the deflector fin and the second deflector fin.

In some embodiments, the dishwashing machine may also include a dish rack positioned above the spray arm and the spray jet. The dish rack may have a number of staggered tiers. In some embodiments, the spray arm may be positioned at a non-perpendicular angle relative to a bottom surface of the washing chamber.

In some embodiments, the dishwashing machine may include a lower dish rack positioned below the spray arm. The basket may be positioned in the lower dish rack.

In some embodiments, the spray arm may have a longitudinal axis, and the deflector fin may have a longitudinal axis. The longitudinal axis of the spray arm and the longitudinal axis of the deflector fin may form an angle of intersection there between. In some embodiments, the angle defined between the longitudinal axis of the spray arm and the longitudinal axis of the deflector fin may be approximately sixty degrees.

In some embodiments, the dishwashing machine may further include a manifold having the spray jet mounted therein. The spray arm may be rotatably coupled to a lower end of the manifold. In some embodiments, the dishwashing machine may include a dish rack mounted within the washing chamber above the basket. The manifold may be coupled to the dish rack.

According to another aspect, the dishwashing machine includes a washing chamber and a basket positioned in the washing chamber. The basket has a portion thereof located within a target spray zone. A spray jet is mounted within the washing chamber, and the spray jet is operable to direct a fluid stream into the target spray zone. A rotatable spray arm is positioned beneath the spray jet, and the spray arm includes a deflector fin extending upwardly there from. When the rotatable spray arm is positioned in an obstructing position within the target spray zone, the fluid stream contacts the deflector fin to rotate the spray arm to a non-obstructing position outside of the target spray zone.

In some embodiments, the deflector fin may extend perpendicular to an upper surface of the spray arm. In some embodiments, the dishwashing machine may include a plurality of spray jets, each spray jet having a separate nozzle defined therein.

Additionally, in some embodiments, the spray arm may rotate about an imaginary axis extending upwardly from a bottom surface of the washing chamber, and the spray jet may be in a fixed position relative to the imaginary axis. In some embodiments, the dishwashing machine may include a dish rack positioned above the spray arm. The dish rack may have the spray jet secured thereto.

According to another aspect, a method of washing flatware in a dishwashing machine is disclosed. The method includes supplying fluid to a spray jet of the dishwashing machine, expelling fluid from the spray jet toward a basket having flatware positioned therein, and contacting a deflector fin of a spray arm located in an obstructing position with fluid expelled from the spray jet such that the spray arm is rotated to a non-obstructing position. In some embodiments, the method may also include supplying fluid to a spray jet includes supplying substantially no fluid to the spray arm.

BRIEF DESCRIPTION OF THE DRAWINGS

The detailed description particularly refers to the following figures, in which.

DETAILED DESCRIPTION OF THE DRAWINGS

Figure 1:
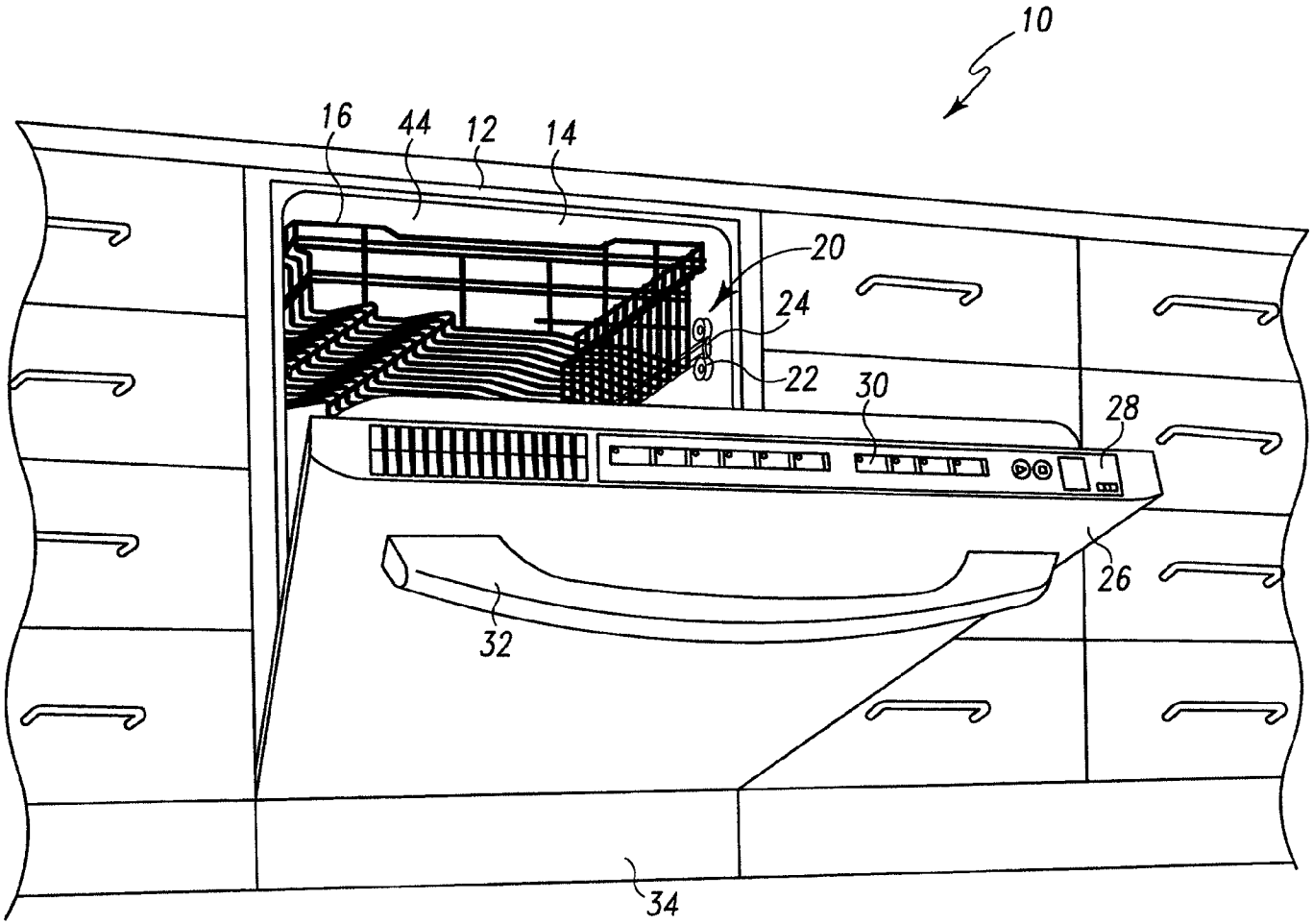
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwashing machine 10 (hereinafter dishwasher 10) is shown. The dishwasher 10 includes a tub 12 that defines a washing chamber 14 into which a user may place dishes and other cooking and eating wares (e.g., plates, bowls, glasses, flatware, pots, pans, bowls, etc.) to be washed. The dishwasher 10 includes an upper dish rack 16 and a lower dish rack 18 (see FIG. 2). A number of roller assemblies 20 are positioned between the dish racks 16, 18 and the tub 12.

The roller assemblies 20 allow the dish racks 16, 18 to extend from and retract into the tub 12, which facilitates the loading and unloading of the dish racks 16, 18. The roller assemblies 20 include a number of rollers 22 that move along a corresponding support rail 24.

A door 26 is hinged to the lower front edge of the tub 12. The door 26 permits user access to the tub 12 to load and unload the dishwasher 10. The door 26 also seals the front of the dishwasher 10 during a wash cycle. A control panel 28 is located at the top of the door 26. The control panel 28 includes a number of controls 30, such as buttons and knobs, which are used to control the operation of the dishwasher 10. A handle 32 is located on the door 26. The user may use the handle 32 to pull the door 26 open.

A machine compartment 34 is located below the tub 12. The machine compartment 34 is sealed from the tub 12. In other words, unlike the tub 12, which is filled with fluid and exposed to spray during the wash cycle, the machine compartment 34 does not fill with fluid and is not exposed to spray during the operation of the dishwasher 10. The machine compartment 34 houses components such as the dishwasher's fluid pump(s) and valve(s), along with the associated wiring and plumbing.

Figure 2:
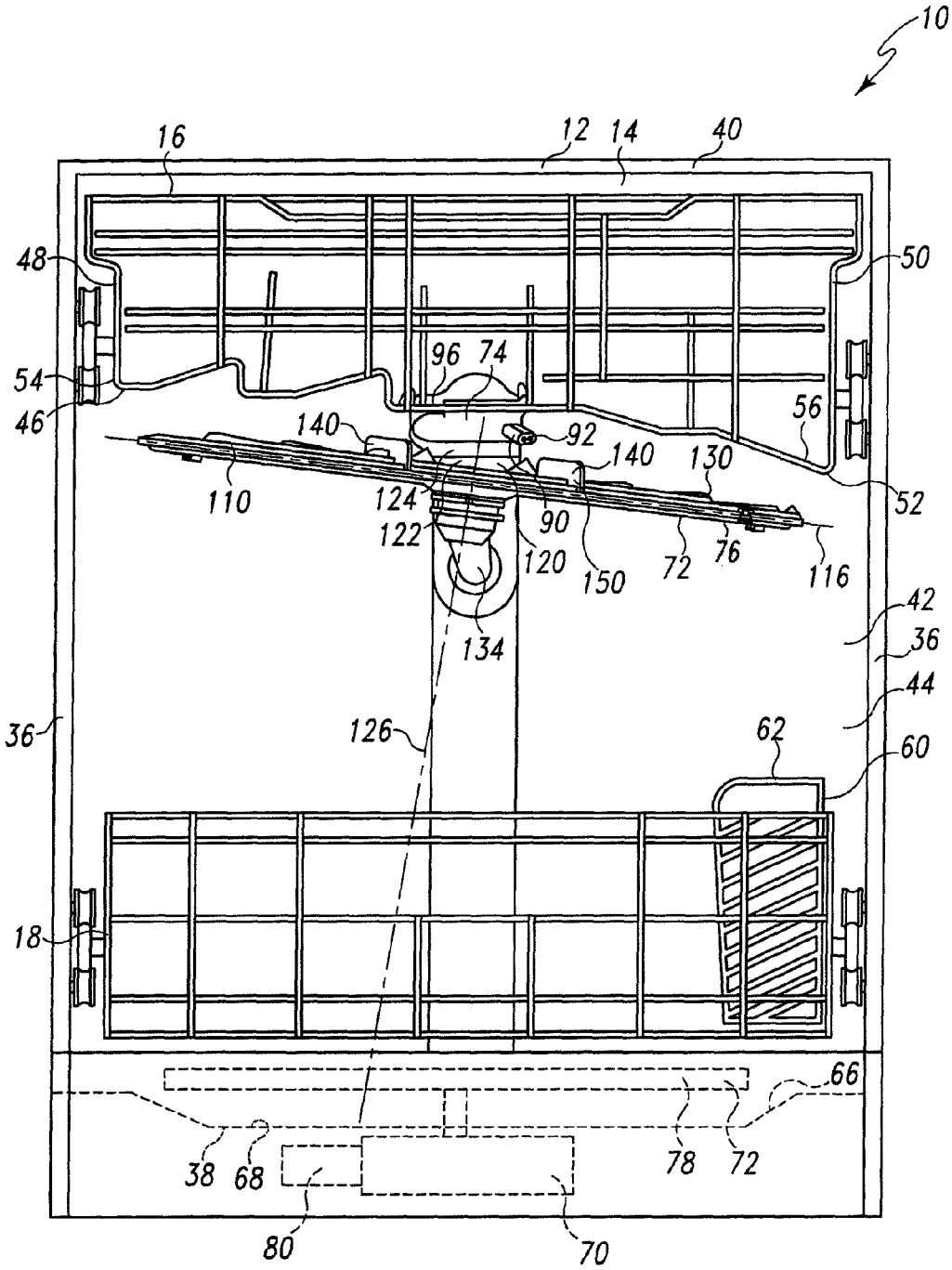
FIG. 2 is a fragmentary front elevational view of the tub of the dishwashing machine of FIG. 1.

Referring now to FIG. 2, the tub 12 of the dishwasher 10 is shown in greater detail. The tub 12 includes a number of side walls 36 that extend upwardly from a bottom wall 38 to a top wall 40, thereby defining the washing chamber 14. The open front side 42 of the tub 12 defines an access opening 44, which provides the user with access to the dish racks 16, 18 positioned in the washing chamber 14 when the door 26 is open. When the door 26 is closed, the door 26 seals the access opening 44, thereby preventing the user from accessing the dish racks 16. The door 26 also prevents fluid from escaping through the access opening 44 of the dishwasher 10 during a dishwashing cycle.

The upper dish rack 16 is positioned adjacent to the top wall 40 of the tub 12. As shown in FIG. 2, the rack 16 has a lower front edge 46 that extends from the left side 48 to the right side 50 of the rack 16, and the lower front edge 46 defines a number of levels or tiers 52. The tiers 52 are staggered such that some of the tiers 52 of the dish rack 16 are positioned closer to the top wall 40 of the tub 12. An upper tier 54 positioned near the left side 48 of the rack 16 is sized to receive smaller wares while a lower tier 56 positioned near the right side 50 of the rack 16 is sized to receive larger wares. In that way, the rack 16 is configured to accommodate wares of varying size. It will be appreciated that in other embodiments the rack 16 may have only a single level or tier 52.

The lower dish rack 18 is positioned below the upper dish rack 16. A basket 62 is positioned within the rack 18 adjacent to the right side 60 of the rack 18. The basket 62 includes a number of slots 64 (see FIG. 3) sized to receive flatware (such as, for example, knifes, forks, spoons, etc.) to be washed. The basket 62 is removable from the rack 18. In other embodiments the basket 62 may be located elsewhere in the washing chamber 14. For example, the basket 62 may be positioned near the front side of the rack 18 or within a slot formed in the door 26. It should also be appreciated that in other embodiments the dishwasher 10 may include more than one basket configured to receive flatware.

Below the lower dish rack 18, a recirculation sump 66 is formed (e.g., stamped or molded) in the bottom wall 38 of the tub 12. In particular, as shown in FIG. 2, the sump 66 defines a reservoir that extends downwardly in a direction away from an upper surface 68 of the bottom wall 38 of the tub 12. The sloped configuration of the bottom wall 38 directs fluid, such as water and/or wash chemistry (i.e., water and/or detergents, enzymes, surfactants, and other cleaning or conditioning chemistry), into the sump 66 during a dishwashing cycle. Such water and/or wash chemistry is drained from the sump 66 and re-circulated onto the dish racks 16, 18 by a wash pump 70 located in the machine compartment 34. The wash pump 70 is connected to several spray devices 72, including a sprayer manifold 74, an upper spray arm 76, and a lower spray arm 78, that spray water and/or wash chemistry onto the dish racks 16, 18 (and hence any wares positioned thereon). It will be appreciated that in other embodiments additional spray devices 72 may be included, such as, for example, another spray arm positioned between the top wall 40 and the upper dish rack 16. In operation, the wash pump 70 is selectively energized to supply fluid from the sump 66 through a diverter valve 80 to one of the spray devices 72.

The diverter valve 80 is operable to selectively divert the supply of fluid from wash pump 70 to the sprayer manifold 74, the upper spray arm 76, or the lower spray arm 78. When positioned in one position, the diverter valve 80 causes fluid to be supplied to the lower spray arm 78. When positioned in other positions, fluid is supplied to the upper spray arm 76 or the lower spray arm 78. In that way, the diverter valve 80 allows fluid to be alternately supplied to the sprayer manifold 74 or to each of the spray arms 76, 78. During some wash stages, the diverter valve 80 may be locked in position such that fluid is supplied only to the sprayer manifold 74, which is configured to spray fluid onto the basket 62 as described below.

Figure 3:
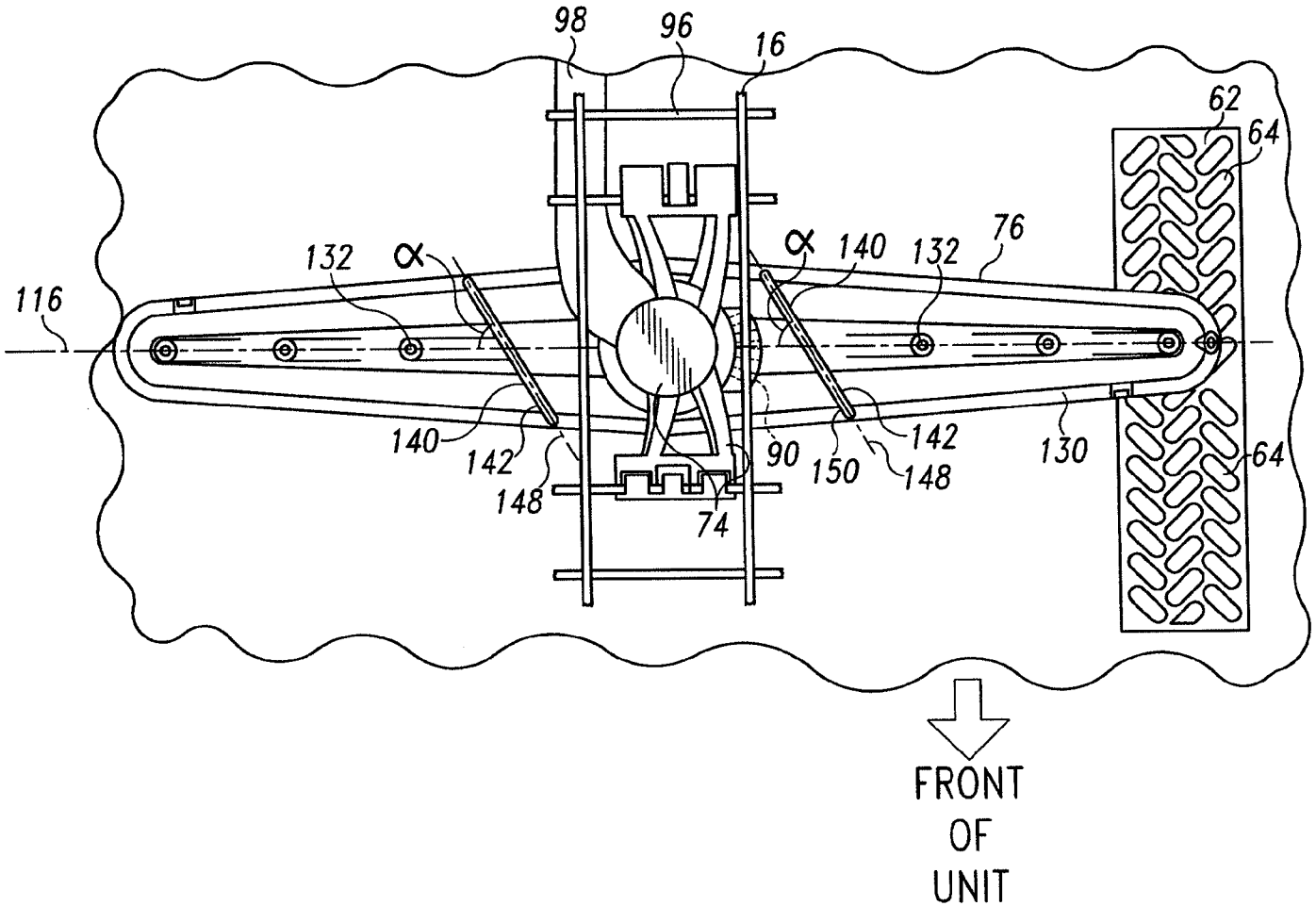
FIG. 3 is a top elevational view of the tub of the dishwashing machine of FIG. 1 showing the upper spray arm positioned in an obstructing position within the target spray zone.

The sprayer manifold 74 is positioned below the upper dish rack 16. As shown in FIGS. 2 and 3, an upper surface 94 of the sprayer manifold 74 is coupled to a tier 96 of the upper dish rack 16. The manifold 74 includes a plurality of spray jets 90, each of which has a nozzle 92 formed therein. A transfer tube 98 (see FIG. 3) extending between the manifold 74 and the back of the tub 12 places the spray jets 90 in fluid communication with the pump 70 and the diverter valve 80. When the valve 80 is appropriately positioned, fluid passes from the pump 70 into the manifold 74 through the transfer tube 98 and exits from the manifold 74 through each of the nozzles 92. In the illustrative embodiment described herein, each nozzle 92 is embodied simply as a hole formed at the end of each of the spray jets 90. However, it is within the scope of the disclosure for each nozzle 92 to include inserts such as tips or other similar structures that are placed into the holes formed in the spray jets 90. Such inserts may be useful in configuring the spray direction or spray pattern of the fluid expelled from the spray jets 90.

Figure 4:
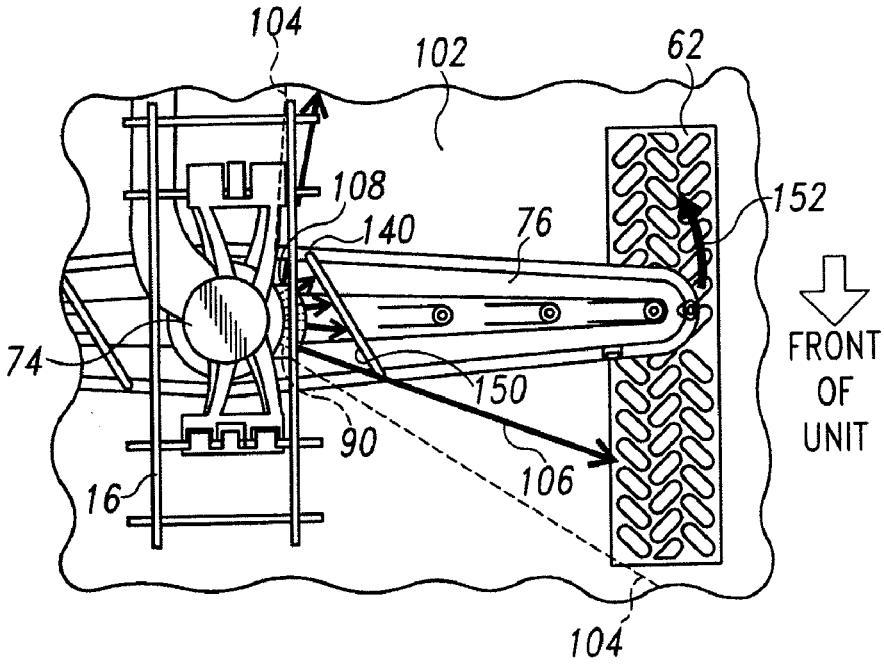
FIGS. 4 and 5 are top elevational views of the tub of the dishwashing machine of FIG. 1 showing the fluid streams directed into the target spray zone.
Figure 5:
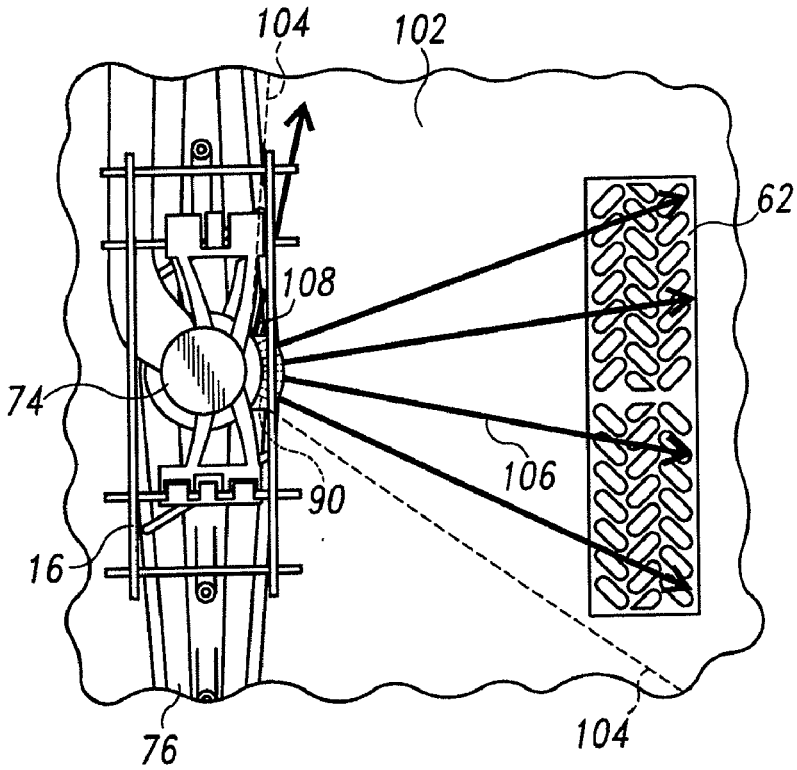

Each of the spray jets 90 is configured to direct expelled fluid into a target spray zone 102 defined within the washing chamber 14. As shown in FIGS. 4-5, a pair of imaginary lines 104 defines the outer boundaries of the target spray zone 102, and a number of arrows 106 illustrate the fluid paths of each of the spray jets 90. Four of the spray jets 90 are configured to spray fluid on at least a portion of the basket 62 while a fifth spray jet is configured to spray fluid toward the back of the tub 12, as illustrated by arrow 108. In other embodiments, additional spray jets may be included in the dishwashing machine 10. Similarly, in other embodiments, the washing chamber 14 may include additional target spray zones and additional spray devices 72. It should also be appreciated that in other embodiments the spray jets 90 may be operable to direct expelled fluid into other spray zones separate from, or in addition to, the target spray zone 102.

Returning to FIG. 2, the upper spray arm 76 is positioned between the dish racks 16, 18. The spray arm 76 includes a housing 110 having a longitudinal axis 116. The term "longitudinal axis" as used herein refers to the long axis of a structure, and the longitudinal axis 116 of the spray arm 76 follows the slope of the tiers 52 of the rack 16 when the spray arm 76 is positioned as shown in FIG. 2. In that way, the spray arm 76 is tilted or angled relative to the bottom wall 38 of the tub 12. It should be appreciated that in other embodiments the housing 110 (and, consequently, axis 116) may be positioned parallel to the bottom wall 38 of the tub 12 such as, for example, in embodiments where the upper dish rack 16 is not divided into multiple, staggered tiers 52 but instead includes only a single tier 52 positioned parallel to the bottom wall 38.

A central shaft 120 is formed in the housing 110. An upper end 122 of the central shaft 120 is rotatably coupled to the sprayer manifold 74 via a bearing 124 such that the spray arm 76 rotates about a rotational axis 126. The rotational axis 126 is perpendicular to the longitudinal axis 116 of the housing 110 but is positioned at a non-perpendicular angle relative to the bottom wall 38 of the tub 12. It should be appreciated that in other embodiments the rotational axis 126 may also extend perpendicularly to the bottom wall 38.

The housing 110 of the upper spray arm 76 includes a contoured upper surface 130 having a number of nozzles 132 (see FIG. 3) defined therein. A transfer tube 134 extending between the spray arm 76 and the back of the tub 12 places the spray arm 76 in fluid communication with the pump 70 and the diverter valve 80. When the valve 80 is appropriately positioned, fluid passes from the pump 70 into the spray arm 76 through the transfer tube 134 and then exits the spray arm 76 through the nozzles 132 thereby causing the spray arm 76 to rotate about the axis 126. In the illustrative embodiment described herein, each of the nozzles 132 is embodied simply as a hole formed in the contours of the spray arm 76. However, it is within the scope of the disclosure for each of the nozzles 132 to include inserts such as tips or other similar structures that are placed into the holes formed in the spray arm 76. Such inserts may be useful in configuring the spray direction or spray pattern of the fluid expelled from each of the nozzles 132.

Referring to FIGS. 2 and 3, the spray arm 76 includes a pair of deflector fins 140. The rotational axis 126 of the spray arm 76 extends between the deflector fins 140. Each deflector fin 140 has a body 142 that extends upwardly from, and perpendicular to, the upper surface 130 of the spray arm 76. In other embodiments, the body 142 of each deflector fin 140 may extend upwardly from the upper surface 130 of the spray arm 76 at an angle other than ninety degrees.

The body 142 includes a sidewall 150 that faces the rotational axis 126. When the spray arm 76 is positioned as shown in FIG. 2, the sidewall 150 of one of the deflector fins 140 faces the nozzles 92 of the spray jets 90. In that position, at least one of the fluid streams generated by the nozzles 92 contacts the sidewall 150 facing the spray jets 90 (see FIGS. 4 and 5).

The body 142 of each deflector fin 140 extends along a longitudinal axis 148. The longitudinal axis 148 is traverse to the longitudinal axis 116 of the spray arm 76. As shown in FIG. 2, an angle of intersection $\alpha$ is defined between the axes 116, 148. In the illustrative embodiment, the angle of intersection $\alpha$ is approximately sixty degrees. It should be appreciated that other angles of intersection a may be used in other embodiments. Additionally, in other embodiments additional deflector fins may be added to the spray arm 76.

In operation, the wash pump 70 selectively supplies fluid, which may be water and/or wash chemistry, to the spray devices 72 over a dishwashing cycle. For example, when fluid is supplied to the upper spray arm 76, the spray arm 76 rotates about the rotational axis 126 as fluid is expelled from the nozzles 132 onto the wares positioned on the dish rack 16. The pump 70 draws fluid from the sump 66 (or a water supply line) and passes fluid into the spray arm 76. Fluid then exits the spray arm 76 through the nozzles 132 as a spray directed at the dish rack 16 (and hence any wares positioned thereon).

At the beginning of a particular wash stage of the dishwashing cycle, the diverter valve 80 is actuated such that fluid is diverted from the spray arm 76 to the sprayer manifold 74. Fluid supplied to the sprayer manifold 74 is expelled from the nozzles 92 of the spray jets 90. As described above, the pump 70 draws fluid from the sump 66 (or a water supply line) and passes fluid to the spray jets 90 through the manifold 74. Fluid then exits the spray jets 90 through the nozzles 92 as a stream directed at the dish rack 18 and the basket 62 (and hence any wares positioned thereon).

When fluid is diverted from the spray arm 76, the spray arm 76 begins losing angular velocity and gradually stops rotating about the axis 126. As shown in FIGS. 3-5, the spray arm 76 may come to a stop at an obstructing position where a portion of the spray arm 76 is positioned within the target spray zone 102. In such a position, the spray arm 76 obstructs the fluid path of at least some of the spray jets 90, as illustrated by the arrows 106.

When the spray arm 76 is positioned within the target spray zone 102, fluid expelled from the spray jets 90 contacts the side wall 150 of one of the deflector fins 140. The force of the water causes the spray arm 76 to rotate about the axis 126 in the direction indicated by an arrow 152. As the spray arm 76 is rotated, the flow path of each of the spray jets 90 is cleared such that fluid spray reaches the basket 62 and any wares positioned therein. As shown in FIG. 5, the fifth spray jet, which is configured to spray fluid toward the back of the tub 12 along the path indicated by the arrow 108, ensures that the spray arm 76 is rotated is moved to a non-obstructing position outside of the target spray zone 102.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A dishwashing machine, comprising:

a washing chamber, a basket positioned within the washing chamber, the basket being configured to receive flatware, a spray jet positioned above the basket, the spray jet being operable to generate a fluid stream directed toward a portion of the basket, and a rotatable spray arm positioned between the spray jet and the basket, the spray arm having a deflector fin extending upwardly there from, wherein the spray arm is rotated when the fluid stream from the spray jet contacts the deflector fin.

2. The dishwashing machine of claim 1, wherein:

the spray arm includes a number of nozzles configured to spray fluid throughout the washing chamber, and the spray jet is deactivated when the number of nozzles of the spray arm are spraying fluid.

3. The dishwashing machine of claim 2, wherein the spray arm rotates about an imaginary axis extending upwardly from a bottom surface of the washing chamber when the number of nozzles of the spray arm are spraying fluid.

4. The dishwashing machine of claim 3, wherein:

a second deflector fin extends upwardly from the spray arm, and the imaginary axis is positioned between the deflector fin and the second deflector fin.

5. The dishwashing machine of claim 1, further comprising a dish rack positioned above the spray arm and the spray jet, the dish rack having a number of staggered tiers.

6. The dishwashing machine of claim 5, wherein the spray arm is positioned at a non-perpendicular angle relative to a bottom surface of the washing chamber.

7. The dishwashing machine of claim 5, further comprising a lower dish rack positioned below the spray arm, wherein the basket is positioned in the lower dish rack.

8. The dishwashing machine of claim 1, wherein:

the spray arm has a longitudinal axis, the deflector fin has a longitudinal axis, and the longitudinal axis of the spray arm and the longitudinal axis of the deflector fin define an angle of intersection there between.

9. The dishwashing machine of claim 8, wherein the angle of intersection defined between the longitudinal axis of the spray arm and the longitudinal axis of the deflector fin is approximately sixty degrees.

10. The dishwashing machine of claim 1, further comprising a manifold having the spray jet mounted therein, wherein the spray arm is rotatably coupled to a lower end of the manifold.

11. The dishwashing machine of claim 10, further comprising a dish rack mounted within the washing chamber above the basket, wherein the manifold is coupled to the dish rack.

12. A dishwashing machine, comprising:

a washing chamber, a basket positioned in the washing chamber, the basket having a portion thereof located within a target spray zone, a spray jet mounted within the washing chamber, the spray jet being operable to direct a fluid stream into the target spray zone, and a rotatable spray arm positioned beneath the spray jet, the spray arm including a deflector fin extending upwardly there from, wherein when the rotatable spray arm is positioned in an obstructing position within the target spray zone, the fluid stream contacts the deflector fin to rotate the spray arm to a non-obstructing position outside of the target spray zone.

13. The dishwashing machine of claim 12, wherein the deflector fin extends perpendicular to an upper surface of the spray arm.

14. The dishwashing machine of claim 12, further comprising a plurality of spray jets, each spray jet having a separate nozzle defined therein.

15. The dishwashing machine of claim 12, wherein:

the spray arm rotates about an imaginary axis extending upwardly from a bottom surface of the washing chamber, and the spray jet is in a fixed position relative to the imaginary axis.

16. The dishwashing machine of claim 12, further comprising a dish rack positioned above the spray arm, the dish rack having the spray jet secured thereto.

17. A method of washing flatware in a dishwashing machine, comprising:

supplying fluid to a spray jet of the dishwashing machine, expelling fluid from the spray jet toward a basket having flatware positioned therein, and contacting a deflector fin of a spray arm located in an obstructing position with fluid expelled from the spray jet such that the spray arm is rotated to a non-obstructing position.

18. The method of claim 17, further comprising supplying fluid to a spray jet includes supplying substantially no fluid to the spray arm.

* * * * *